United States Patent [19]

Jayne et al.

[11] 4,012,331

[45] Mar. 15, 1977

[54] SULPHUR COMPOUNDS

[75] Inventors: Gerald John Joseph Jayne; Herbert Frank Askew, both of Wokingham; David Robert Woods, Bracknell, all of England

[73] Assignee: Edwin Cooper and Company Limited, Bracknell, England

[22] Filed: July 21, 1975

[21] Appl. No.: 597,674

[30] Foreign Application Priority Data

July 25, 1974 United Kingdom ..... 32976/74

[52] U.S. Cl. ..... 252/48.2; 252/45; 260/125; 260/327 H

[51] Int. Cl.[2] ..... C10M 1/38

[58] Field of Search ..... 252/48.2, 45; 260/125, 260/327 H

[56] References Cited

UNITED STATES PATENTS

| | | | |
|---|---|---|---|
| 2,537,297 | 1/1951 | Alexander | 252/45 |
| 2,543,542 | 2/1951 | Badertscher et al. | 252/45 |
| 3,376,225 | 4/1968 | Anderson | 252/48.2 |
| 3,586,700 | 6/1971 | Kurtz et al. | 260/327 H |
| 3,632,566 | 1/1972 | Coleman | 260/125 |
| 3,882,031 | 5/1975 | Askew et al. | 252/45 |
| 3,928,217 | 12/1975 | Labat et al. | 252/45 |

*Primary Examiner*—Lewis Gotts
*Assistant Examiner*—D. R. Phillips
*Attorney, Agent, or Firm*—Donald L. Johnson; Robert A. Linn; Joseph D. Odenweller

[57] ABSTRACT

A process for the preparation of a sulphur compound suitable for use as a lubricant additive comprises reacting a trithiolan compound with a thiol compound in the presence of a base.

17 Claims, No Drawings

SULPHUR COMPOUNDS

The present invention relates to sulphur-containing products, more particularly to such products which are useful as lubricant additives. The invention also relates to a process for preparing the products and lubricating compositions containing the product.

For many years metal, particularly zinc, salts of dihydrocarbyl dithiophosphoric acids have been incorporated in virtually all premium grade automotive lubricants, and also in lubricants for other purposes. This wide usage has arisen since such additives are comparatively easy and inexpensive to manufacture and have an exceptional combination of desirable properties including the ability to impart antioxidant and anti-wear characteristics to the lubricant and the ability to inhibit corrosion of bearings, particularly composite copper/-lead bearings, employed in the construction of many engines. Numerous alternative additives have been proposed and many of these have comparable properties with zinc dihydrocarbyl dithiophosphates in one or more respects. However, such additives have also had deficiencies in one or more respects, corrosion inhibition of copper/lead bearings being an especially difficult problem. Consequently such alternatives have not succeeded in any significant degree in supplanting zinc dihydrocarbyl dithiophosphates from commerical usage.

More recently, developments in engine design have led to a growing tendency for the quality standards laid down by manufacturers and other interested organisations to specify low-ash lubricant formulations for modern engines; whereas the metal content of zinc dihydrocarbyl dithiophosphates is a source of ash. Furthermore, it is expected that in the near future there will be widespread use of catalytic devices in engine exhausts to minimize pollution caused by vehicle emission. The catalysts used in such devices are believed to be sensitive to phosphorus compounds, i.e., it is believed that such catalysts may be poisoned and rendered ineffective by exposure to phosphorus compounds. Consequently, the need has arise for antioxidants which do not contain metal or phosphorus, and yet still perform satisfactorily in those roles hitherto filled by zinc dihydrocarbyl dithiophosphates.

In U.S. Pat. No. 3,882,031 there is disclosed the use in lubricants of certain sulphur-containing products which in large measure fulfil this need. However, such products are desirably improved upon and we have now found certain new products, which may be derivatives of the products of U.S. Pat. No. 3,882,031, and which have improved performance with respect to inhibition of bearing corrosion and also have improved oil solubility for a given sulphur content, yet which fully retain the extremely advantageous combination of other properties found in the products of U.S. Pat. No. 3,882,031.

Accordingly, the present invention provides a process, for the preparation of a sulphur compound suitable for use as a lubricant additive, wherein a trithiolan compound is reacted with a thiol compound in the presence of a base.

The present invention also includes the products of the foregoing process, and lubricants containing such products.

Trithiolan compounds are organic compounds containing a heterocyclic ring having the structure:

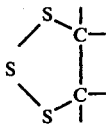

When reacted in the presence of a base with a thiol i.e., an organic compound containing the group —S—H, it is thought that the heterocyclic ring undergoes scission to form substances the structure of which is not known with precision (but which is believed to be, at least in part, polymeric). The substances contain a high sulphur content (e.g., up to 40% by weight or higher) and have exceptionally good oil solubility for compounds of such high sulphur content.

The trithiolan compounds used in the process of the present invention may be any of the well known trithiolan compounds, for example the compounds disclosed and described in U.S. Pat. No. 3,586,700. These trithiolan compounds may be prepared by sulphurising an appropriate norbornenyl compound in the presence of a highly polar organic solvent such as dimethyl formamide. In one aspect of the process of the present invention therefore the trithiolan compound used has the general formula:

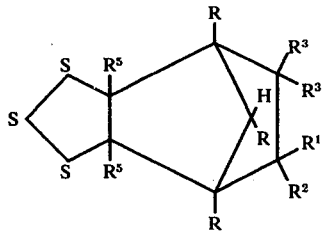

(A)

wherein:

a. each of R, $R^2$ and $R^4$ when taken singly is a hydrogen atom, an alkyl group containing from 1 to about 15 carbom atoms, an aryl group containing from 6 to about 15 carbon atoms or a cycloalkyl group containing from 4 to about 10 carbon atoms;

b. each $R^1$ and $R^3$ when taken singly is a hydrogen atom, an alkyl group containing from 1 to about 15 carbon atoms; an aryl group containing from 6 to about 15 carbon atoms; a cycloalkyl group containing from 4 to about 10 carbon atoms or an alkenyl group containing from 2 to about 10 carbon atoms or $R^1$ and $R^3$ taken together form the group —CHY.CY=CY— in which Y is a hydrogen atom or a methyl group or $R^1$ together with $R^2$ form an alkylidene group containing from 1 to about 6 carbon atoms; and c. $R^5$ is a hydrogen atom or an alkyl group containing from 1 to about 15 carbon atoms.

However, in an alternative, and preferred, embodiment of the present invention the trithiolan compound used is a product prepared by the process of U.S. Pat. No. 3,882,031. Such products are believed to contain large amounts of and may consist substantially entirely of, trithiolan compounds and accordingly it is to be understood that in the context of the present specification the term "trithiolan compound" is intended to include within its scope the products of the process of U.S. Pat. No. 3,882,031.

The process of U.S. Pat. No. 3,882,031 comprises sulphurizing a compound having the general formula:

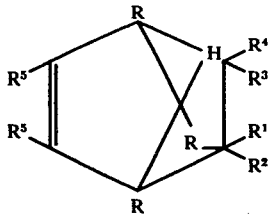

in which R, $R^1$, $R^2$, $R^3$, $R^4$ and $R^4$ are as hereinbefore defined, at a temperature of up to 180° C., said sulphurization being carried out in the absence of a solvent or in the presence of a non-polar solvent.

Examples of compounds which may be sulphurized in the process of U.S. Pat. No. 3,882,031 are norbornene, 5-vinylnorbornene, dicyclopentadiene and methyl cyclopentadiene dimer are especially preferred. The resulting products, particularly the products derived from dicyclopentadiene and methyl cyclopentadiene dimer, are the preferred starting materials for the process of the present invention.

If desired the sulphurization may be carried out in the presence of a catalyst of the type commonly used in sulphurization reactions, for example tertiary amines such as triethylamine or pyridine, secondary amines such as di-isopropylamine, di-butylamine, and di-cyclohexylamine and primary amines such as cyclohexylamine and the $\alpha,\alpha$-dimethyl tertiary alkyl primary amines available commercially under such trade names as Primene JM-T and Primene 81-R. Other catalysts which may be used include:

2,5 - Dimercapto - 1,3,4-thiadiazole
2,5 - Dimercapto - 1,2,4-thiadiazole
2,5 - Bis(t-octyldithio) - 1,3,4-thiadiazole
Mercaptobenzothiazole
Sulphide ions, e.g., provided by sodium sulphide
Alkanolamines
Diphenyl guanidine
A mixture of NaOH and mercaptobenzothiazole peroxide such as the material marketed as tertiary butyl hydroperoxide consisting of about 70% of that peroxide together with about 30% di-t-butyl peroxide Particularly preferred catalysts are combinations of an amine and a thiadiazole derivative.

The amount of catalyst used is not critical, but normally will be about 0.1 to 20%, more preferably 0.1 to 10% and most preferably 0.3 to 2%, by weight based on the weight of the compound to be sulphurized.

The products of catalyzed sulphurization reactions may also be employed as starting materials for the process of the present invention.

The sulphurization may also be carried out in the presence of a small amount, e.g., not more than 25 molar percent based on the compound to be sulphurized, of a solubilizing agent. Examples of solubilizing agents which may be used are:

Conjugated di- or poly-olefins such as alloocimene (1,5-dimethyl-2,4,6-octatriene)
Non-conjugated di- or poly-olefins such as (1,5,9-cyclododecatriene and 1,5-cyclooctadiene
Dialkyl maleates, preferably containing from 1 to 12, more preferably 4 to 8, carbon atoms in each alkyl group, e.g., dibutyl maleate
Alkenyl succinic acids or anhydrides thereof, preferably containing 8 to 12 carbon atoms in the alkenyl group, such as dodecenyl succinic acid
Alkyl mercaptans, preferably containing 8 to 12 carbon atoms such as t-dodecyl mercaptan
Polyisobutenyl succinimides
Mercaptobenzothiazole
Benzothiazole disulphide
Alkenoic acids, preferably containing from 8 to 18 carbon atoms such as oleic acid
Alkyl esters of alkenoic acids such as octyl methacrylate
Ethoxylated amines such as the material available commercially under the trade name Ethomeen T15
Dimerised alkenoic acids, preferably containing from 18 to 36 carbon atoms
Dicyclopentadiene hydrate
Alkanols, such as isodecanol.

When used in the sulphurization reaction of U.S. Pat. No. 3,882,031, normally in amounts of from 1 to 25, preferably 2 to 15 molar percent, the solubilizing agent may assist in increasing the oil-solubility of the product. Such "solubilized" products may be used as the trithiolan starting material of the present invention. However, the thiol treatment of the present invention appears to improve oil solubility of the final product such that the use of a solubilizing aid may often be rendered superfluous and it may be preferable therefore to use as the trithiolan starting material a product in accordance with U.S. Pat. No. 3,882,031 prepared without recourse to the use of a solubilizing agent.

In the process of U.S. Pat. No. 3,882,031 the sulphur is preferably used in an amount of from 0.1 to 4 moles per mole of compound to be sulphurized, with an amount of about 1 to 2 moles per mole of compound to be sulphurized being most preferred.

However, the superior oil-solubility of the thiol treated products of the present invention enables the use of a somewhat larger proportion of sulphur to still achieve final products which are oil soluble. Accordingly, in one aspect of the present invention the trithiolan starting material is a product in accordance with U.S. Pat. No. 3,882,031 prepared from about 1 to 4 moles of sulphur per mole of compound to be sulphurized.

The sulphurization reaction of U.S. Pat. No. 3,882,031 may be conveniently carried out by merely mixing the reactants, including any catalyst, and/or solubilizing agent used, and heating. Alternatively, the compound to be sulphurized can be added to hot sulphur. However, when using a relatively high amount of sulphur, i.e., an amount in the upper end of the preferred range, it is preferred to add the sulphur in portions over an initial period to the compound to be sulphurised maintained at the reaction temperature and then to continue maintaining the reaction temperature for a further period.

In general a reaction temperature of at least 60° C is preferred, with at least 90° or 100° C being most preferred for providing the preferred sulphurized materials as hereinbefore described. Also, a reaction temperature no greater than 160° C is preferred. Sulphurization is normally completed in from 0.5 to 24 hours depending on the reaction temperature. At the optimum temperature of about 110° to 140° C a reaction time of about 2 hours is generally found to be most satisfactory, the co-reactants either being mixed and heated for 2 hours or the sulphur being added to the compound to be sulphurized in portions over, for example 1 hour at 120° C and this temperature than being maintained for a further hour.

The sulphurization may, if desired, be carried out in an inert atmosphere such as a nitrogen blanket. The pressure at which the sulphurization is carried out is not critical, but is preferably not reduced to a level at which significant amounts of the compound being sulphurized are lost from the reaction system by distillation.

Although it is preferred to carry out the sulphurization in the absence of a solvent it is also possible to carry out the reaction in the presence of a non-polar solvent, examples of the latter being petroleum ether, toluene, benzene, xylene and mineral oil (especially a mineral lubricating oil).

The thiol co-reactant of the present invention may be chosen from a wide range of well known thiol compounds in which the —S—H group is attached to various organic moieties. The latter can be for example an aryl group as in the case of thiophenol or a substituted aryl group as in the case of p - toluenethiol and thiosalicylic acid (o - mercaptobenzoic acid). Preferred thiol compounds are those in which the —S—H group is attached to an aliphatic moiety. The aliphatic moiety may bear substituents additional to the thiol group, for example the —S—H group may form part of a larger substituent group as in the case of thio-acetic acid

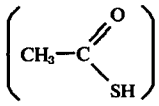

or the —S—H group may be attached to an alkyl group bearing one or more additional and separate, substituents such as:

hydroxy groups, as in 1-thioglycerol;

carboxyl groups, as in thioglycolic acid, 3-mercaptopropionic acid ($HS—CH_2—CH_2COOH$), thiomalic acid

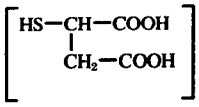

and thiolactic acid

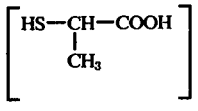

;

aryl groups, as in benzyl mercaptan and p-dodecylbenzyl mercaptan;

ester groups, as in the methyl, ethyl, n-butyl, isooctyl, dodecyl, tridecyl, octadecyl and methoxyethyl esters of thioglycolic and 3-mercaptopropionic acids;

carboxylic acid salts groups, as in monoethanolamine thioglycolate ($HS — CH_2—COONH — CH_2—CH_2—OH$); and heterocyclic radicals, as in furfuryl mercaptan

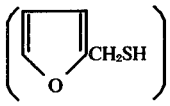

The thiol may, if desired, contain more than one thiol group, e.g., as in 2,5-dimercapto - 1,3,4- thiadiazole or the esters prepared by esterifying a thiol such as thioglycolic acid or 3-mercaptopropionic acid with di- or poly-hydroxy compounds such as ethylene glycol, pentaerythritol, trimethylolethane and trimethylolpropane. Examples of such esters are glycol dimercaptoacetate

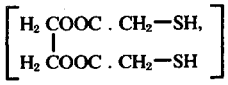

trimethylolpropane trithioglycolate ($CH_3—CH_2—C(CH_2OOC—CH_2—SH)_3$ and pentaerythritol tetra (3-mercapto-propionate ($C(CH_2—OOC—CH_2—SH)_4$)

However, preferred thiol co-reactants for use in the present invention are hydrocarbyl thiols or dithiols, particularly aliphatic mercaptans of the formula $R^6—SH$ wherein $R^6$ is an aliphatic hydrocarbyl group, more preferably an alkyl group. Such groups $R^6$ may be straight or branched chain, the latter being preferred since chain branching generally enhances oil solubility. Particularly preferred branched chain mercaptans are those in which group —SH is attached to a tertiary carbon atom as such mercaptans react most readily in the process of the present invention and give superior products as evaluated by performance in engine tests. The size of the group $R^6$ is not critical in the process of the present invention however, comparatively short chain, e.g., from 1 to 12, especially 4 to 8, carbon atoms are preferred.

If desired the thiol co-reactant of the present invention may be used in the form of its salt, e.g., as an amine or alkali metal, such as potassium, salt of the thiol and it is to be understood that the term thiol employed herein embraces such salts.

The third essential component of the reaction mixture employed in the present invention is a base, which may be either inorganic or organic. For example the base may be a metal, especially an alkali metal, hydroxide which may be used as an aqueous solution. Specific examples of such bases are aqueous Na OH and aqueous KOH. Alternatively, the base may be organic, such as a quaternary ammonium salt or pyridine. Preferred organic bases are aliphatic primary, secondary or tertiary mono, di or polyamines such as n-butylamine, triethylamine, diisopropylamine, t-butylamine and hexamethylene diamine and polyalkylene polyamines such as tetraethylene pentamine and triethylene tetramine.

The process may be readily carried out by mixing the trithiolan compound, thiol and base and heating the resulting mixture. The reaction temperature is not critical and may be up to, and including, the reflux temperature of the reaction mixture. However, a reaction temperature of from 50° to 140° C is preferred, particularly a temperature of from 80° to 120° C. The reaction is normally completed in from 1 to 4 hours.

The relative proportions of the reactants is likewise not critical. A molar ratio of from ½ to 4 parts trithiolan compound per mole of thiol is usually most suitable, with a molar ratio of trithiolan to thiol of from 1 to 2:1 normally being the optimum proportion of reactants. It is believed that the amount of trithiolan decomposed is proportional to the amount of thiol used and therefore the trithiolan compound may not be completely decomposed even when a large excess of thiol is used. The preferred quantity of base used is 10% molar excess over the amount of thiol.

If desired the reactants may be dissolved in an inert solvent, such as a hydrocarbon solvent. Examples of suitable solvents are benzene, xylene toluene, petroleum ether and mineral oil, preferably a mineral lubricating oil.

As hereinbefore described the present invention also includes lubricants containing the products of the process. Preferably such lubricants comprise a major amount of a mineral or synthetic lubricating oil and a minor amount, for example from 0.1 to 10%, more preferably from 0.25 to 5%, by weight based on the total weight of the lubricant, of the products prepared in accordance with the process of the present invention.

It will be understood that the lubricants of the present invention may also contain, if desired, conventional lubricant additives such as ancillary antioxidants and anti-wear additives (preferably ashless), corrosion inhibitors, dispersants, particularly dispersants of the succinimide type, detergents, thickeners, pour-point depressants and viscosity index improvers.

The additives of the present invention may also be conveniently prepared as a concentrate consisting of a concentrated solution of a major amount of the additives and a minor amount of mineral oil, or as an additive package consisting of a concentrated solution in mineral oil of a major amount of a combination of the additives with one or more conventional additives. Such concentrates and packages are frequently very convenient forms in which to handle and transport additives and are diluted with further quantities of oil, and optionally blended with further additives, before use.

The additives of the present invention, like the additives of U.S. Pat. No. 3,882,031 have particular utility as antioxidant and anti-wear additives. When evaluated in bench tests, such as the Copper Strip Test, and in engine tests, such as the Petter WI test, the additives of the present invention display a superior ability, as compared with the additives of U.S. Pat. No. 3,882,031 to inhibit corrosion of composite metal bearings, even in the absence of corrosion inhibitors such as benzotriazole which may have to be used with the additives of U.S. Pat. No. 3,882,031.

The invention will now be illustrated with reference to the following examples.

EXAMPLE 1

Preparation of sulphurized dicyclopentadiene in accordance with U.S. Pat. No. 3,882,031

To 528g (4 moles) of dicyclopentadiene was added 6 g of 2,5-bis (t-octyl-dithio)-1,3,4-thiadiazole and 6 g of di-isopropylamine and the mixture heated with stirring and under nitrogen to 120° C 384 g (12 mole) of powdered sulphur was then added portion wise to the yellow solution over 1 hour keeping the temperature of 115°–125° C. The addition was exothermic and cooling was applied when necessary. The dark red mixture was heated at 120° C for a further 1 hour and then filtered.

The filtered product was used, without vacuum stripping, as starting material in the subsequent Examples 2 to 19 (except in the case of Example 4 wherein a sulphurized dicyclopentadiene prepared using dibutyl maleate solubilizing agent was used).

EXAMPLE 2

Treatment of sulphurised dicyclopentadiene with t-butyl mercaptan using caustic soda as base Sulphurized dicyclopentadiene, 228 g (1 mole), was dissolved in 200 $cm^3$ of toluene and added to a solution of 22 g (0.55 moles) of sodium hydroxide dissolved in 200 $cm^3$ of water. t-Butyl mercaptan, 45 g (0.5 moles), was added quickly to the stirred solution and the mixture heated to 90° C and maintained at this temperature for 1 hour. It was then transferred to a separating funnel, the dark aqueous layer run off and the organic layer was washed with 100 $cm^3$ of brine before drying (Mg SO4) filtering and distilling off toluene and unreacted dicyclopentadiene under reduced pressure (water pump — 30 cm Hg) up to finally 120° C.

The product was extremely viscous, %S = 36.9

EXAMPLE 3

Treatment of sulphurized dicyclopentadiene with t-butyl mercaptan using amine base A mixture of sulphurized dicyclopentadiene, 91.2 g (0.4 moles), triethylamine 22.2 g (0.22 moles), t-butyl mercaptan 18 g (0.2 moles) and toluene 100 $cm^3$ was refluxed for 2 hours during which time $H_2S$ was evolved. The product was filtered hot and the toluene and unreacted dicyclopentadiene removed under reduced pressure 30 mm Hg at 120° C.

The dark red quite viscous liquid has a %S of 38.5.

EXAMPLES 4 to 39

Further products were prepared using the same general methods as in Examples 2 and 3. Salient details of these preparations are summarized in Table 1.

Copper Strip Tests were carried out on the products of these examples and the ratings obtained are included in Table 1. In this test a copper strip was polished with 150 grade carborundum powder and petroleum ether (boiling point 62°–68° C) and then immersed in a 1% solution of the product under test in 150 Solvent Neutral mineral oil contained in a boiling tube. The tube was placed in an oven at 120° C for 3 hours and the copper strip removed and washed with petroleum ether. A rating was assigned to the strip according to the degree of corrosion shown, as determined by visual inspection. In this test the products prepared in accordance with U.S. Pat. No. 3,882,031 usually achieve a Copper Strip rating of 3*a* or 3*b*.

Rotary Bomb Tests in accordance with The Institute of Petroleum Test Method IP 229 T were carried out on the products of a number of the examples using 2% solutions of these products in 150 solvent neutral mineral oil. The time taken for the initial pressure of 90 psi at ambient to drop to 25 psi or for a sharp drop in pressure (induction period) was measured.

The results were as follows:

Product of Example 9 — 178 mins.
Product of Example 10 — 205 mins.
Product of Example 12 — 288 mins.
Product of Example 22 — 222 mins.
Product of Example 26 — 205 mins.
Product of Example 30 — 145 mins.
Product of Example 32 — 148 mins.
Product of Example 33 — 188 mins.

Normal treatment levels of zinc dialkyldithiophosphates in the same test gave induction periods of 200–210 mins and the base oil gave a result of less than 40 mins.

Example 2 was repeated and the product compared with zinc di-isobutyl dithiophosphate in the well known four-ball test and Timken OK load test. The results of these tests are given in Table 2 and demonstrate that the ashless additives of the present invention are comparable in performance with the widely used zinc dihydrocarbyl dithiophosphates.

Table 1

| Example No | Thiol Compound | Base |
|---|---|---|
| 4 | t-butyl mercaptan | aqueous NaOH |
| 5 | t-butyl mercaptan | aqueous NaOH |
| 6 | t-butyl mercaptan | aqueous NaOH |
| 7 | ethyl mercaptan | aqueous NaOH |
| 8 | n-propyl mercaptan | aqueous NaOH |
| 9 | benzyl mercaptan | aqueous NaOH |
| 10 | t-dodecyl mercaptan | aqueous NaOH |
| 11 | S-butyl mercaptan | aqueous NaOH |
| 12 | t-butyl mercaptan | triethylamine |
| 13 | t-butyl mercaptan | di-isopropylamine |
| 14 | t-butyl mercaptan | n-butylamine |
| 15 | t-butyl mercaptan | t-butylamine |
| 16 | t-butyl mercaptan | aqueous NaOH[d] |
| 17 | t-butyl mercaptan[e] | aqueous NaOH |
| 18[a] | t-butyl mercaptan | aqueous NaOH |
| 19 | t-butyl mercaptan[f] | aqueous NaOH |
| 20 | t-butyl mercaptan[g] | aqueous NaOH |
| 21 | 2,5 dimercapto 1,3, 4-thiadiazole | aqueous NaOH |
| 22 | 2-mercapto benzoic acid | aqueous NaOH |
| 23 | Mercaptosuccinic acid | aqueous NaOH |
| 24 | Mercaptoacetic acid | aqueous NaOH |
| 25 | Thioacetic acid | aqueous NaOH |
| 26 | Thio benzoic acid | aqueous NaOH |
| 27 | n-hexanethiol | aqueous NaOH |
| 28 | n-butanethiol | aqueous NaOH |

| Example No | Reaction Time (hr) | Reaction Temperature (° C) | Solvent | Copper-Strip Test Rating |
|---|---|---|---|---|
| 4 | 1 | 80 | Toluene | 1b |
| 5 | 1½ | 85 | Petroleum Ether[b] | 1b |
| 6 | 2 | 95 | Toluene + mineral oil[c] | 1b |
| 7 | 2 | 80–90 | Toluene | 1b |
| 8 | 2 | 80–90 | Toluene | 1b |
| 9 | 2 | 90–100 | Toluene | 1b |
| 10 | 1 | 100 | Toluene | 1b |
| 11 | 2 | 100 | Toluene | 2a |
| 12 | 4 | 120–130 | Mineral Oil[c] | 1b/2a |
| 13 | 2 | reflux | Toluene | 2a |
| 14 | 2 | 90–100 | Toluene | 1b/2a |
| 15 | 2 | 100 | Toluene | 1b |
| 16 | 2 | 95 | Petroleum ether[b] + Mineral oil[c] | 1b |

Table 1-continued

| | | | | |
|---|---|---|---|---|
| 17 | 1 | 80 | Toluene | 1b |
| 18[a] | 1 | 80 | Toluene | 1b |
| 19 | 1 | 90 | Toluene | 1b/2a |
| 20 | 2 | 80–90 | Toluene | 1a |
| 21 | 2 | 100 | Toluene | 3b |
| 22 | 2 | reflux | Toluene | 3a/b |
| 23 | 2 | reflux | Toluene | 3a |
| 24 | 2 | 100 | Toluene | 3a |
| 25 | 3 | reflux | Toluene | 3b |
| 26 | 2 | reflux | Toluene | 1b/2a |
| 27 | 2 | reflux | Toluene | 1b |
| 28 | 2 | reflux | Petroleum Ether[b] | — |

| Example No | Thiol Compound | Base |
|---|---|---|
| 29 | t-butylmercaptan | pyridine |
| 30 | t-butylmercaptan | 40% aqueous benzyl trimethyl ammonium hydroxide |
| 31 | Sodium t-butyl[h] mercaptide | sodium t-butyl[h] mercaptide |
| 32[i] | t-butyl mercaptan | aqueous NaOH |
| 33[j] | t-butyl mercaptan | aqueous NaOH |
| 34 | t-butyl mercaptan | primene JMT |
| 35 | t-butyl mercaptan | 0.880 Ammonia |
| 36 | 1,6 hexane di thiol[k] | aqueous NaOH |
| 37 | p-thiocresol | aqueous NaOH |
| 38 | t-butyl mercaptan | triethylamine |
| 39[l] | t-butyl mercaptan | triethylamine aqueous NaOH |

| Example No | Reaction Time (hr) | Reaction Temp. (° C) | Solvent | Copper-Strip Test Rating |
|---|---|---|---|---|
| 29 | 2 | reflux | Toluene | 1b/2a |
| 30 | 2 | reflux | Toluene | 1b |
| 31 | 1 | reflux | Toluene | 1b |
| 32[i] | 1 | reflux | Toluene | 1b |
| 33[j] | 1 | reflux | Toluene | 1a |
| 34 | 2 | reflux | Toluene | 1a/2a |
| 35 | 2 | reflux | Toluene | 3a |
| 36 | 2 | reflux | Toluene | 1b |
| 37 | 2 | reflux | Toluene | 1a |
| 38 | 2 | 100 | NIL | 1b |
| 39[l] | 1 | 80 | Toluene | 1b |

Footnotes

[a]Sulphurised norbornene used in place of sulphurised dicyclopentadiene

[b]Boiling point range 80 – 100° C.

[c]Pale spindle oil having viscosities of about 21.5 and 3.5 at 100° F and 210° F respectively.

[d]20% solution used in place of 10% solution.

[e]Trithiolan: thiol molar ratio of 1:2

[f]Trithiolan: thiol molar ratio of 4:1

[g]Trithiolan: thiol molar ratio of 1:1

[h]Sodium t-butyl mercaptide was prepared by refluxing ethanol (20 ml), sodium hydroxide (4.4g 0.11 mole) and t-butyl mercaptan (9g. 0.1 mole) for 2 hours. This solution was then added to the sulphurised dicyclopentadiene (45.6g 0.2m) in toluene (50 ml) followed by water (36 ml.).

[i]In this example the trithiolan compound was the trithiolan derivative of methyl dicyclopentadiene obtained by sulphurising methyl cyclopentadiene in substantially the same manner as in Example 1 using 2.7g moles each of sulphur and methyl cyclopentadiene dimer and 6.5g each of 2,5-bis (t-octyl-dithio-1,3,4-thiadiazole (A150) and disopropylamine.

[j]In this example the trithiolan derivative of exodicyclopentadiene was used having been prepared substantially as in Example 1 from the following starting materials:- exo-dicyclopentadiene (99g 0.75 moles), dibutyl maleate (9.6g 0.042m), sulphur (24g, 0.75m.), A150 (1.64g) and di-isopropylamine (1.63g).

[k]Solubility of final product was not good but better than trithiolan.

[l]Trithiolan derivative was sulphurised norbornylene prepared by refluxing a mixture of norbornylene (188 parts, 2 moles), A150 (1.9 parts), and diisopropylamine (9.4 parts), sulphur (64 parts, 2 moles) being added portionwise over 1½ hours and temperature being maintained at 100° C. for a further 2½ hours. Work-up was substantially as in Example 1. The product had a copper strip result of 3a.

Table 2

| | 4-Ball Wear Test* | | Timken OK Load Test* | | |
|---|---|---|---|---|---|
| ADDITIVE | % of additive | Incipient Siezure Load (Kg) | WELD POINT (Kg) | % of additive | OK LOAD (lb) |
| NONE | — | 50 | 120 | — | <12 |
| ZINC DI-SOBUTYL DITHIO-PHOSPHATE | 0.48 | 75 | 210 | 0.68 | 37 |

Table 2-continued

| ADDITIVE | 4-Ball Wear Test* % of additive | Incipient Siezure Load (Kg) | Timken OK Load Test* WELD POINT (Kg) | % of additive | OK LOAD (lb) |
|---|---|---|---|---|---|
| Product of EXAMPLE 2 | 0.8 | 75 | 230 | 1.0 | 35 |

*Test carried out in 150 Solvent neutral mineral oil.

We claim:

1. A process for the preparation of a sulphur compound suitable for use as a lubricant additive, said process comprising reacting a trithiolan compound having the general formula:

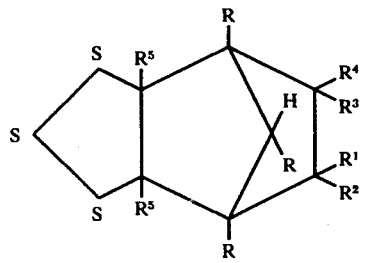

(A)

wherein:

a. each of R, $R^2$ and $R^4$ when taken singly is a hydrogen atom, an alkyl group containing from 1 to about 15 carbon atoms, an aryl group containing from 6 to about 15 carbon atoms or a cycloalkyl group containing from 4 to about 10 carbon atoms;

b. each $R^1$ and $R^3$ when taken singly is a hydrogen atom, an alkyl group containing from 1 to about 15 carbon atoms, an aryl group containing from 6 to about 15 carbon atoms, a cycloalkyl group containing from 4 to about 10 carbon atoms or an alkenyl group containing from 2 to about 10 carbon atoms or $R^1$ and $R^3$ taken together form the group —CHY.CY=CY— in which Y is a hydrogen atom or a methyl group or $R^1$ and $R^2$ taken together form an alkylidene group containing from 1 to about 6 carbon atoms; and c. $R^5$ is a hydrogen atom or an alkyl group containing from 1 to about 15 carbon atoms with a thiol compound in the presence of a base, said thiol compound being selected from the group consisting of thiophenol, alkyl substituted thiophenol, thiosalicylic acid, thioacetic acid, mercapto acetic acid, 1 thioglycerol, thioglycolic acid, thiobenzoic acid, thiolactic acid, benzyl mercaptan, alkyl substituted benzylmercaptan, alkyl and alkoxyalkyl esters of thioglycolic acid and 3-mercaptopropionic acid, mercaptosuccinic acid, ethanolamine thioglycolate, furfuryl mercaptan, 2,5-dimercapto-1,3,4-thiadiazole, hydrocarbyl polyol esters of thioglycolic acid and 3-mercaptopropionic acid, and aliphatic hydrocarbyl thiols and dithiols in which the hydrocarbyl group contains 1–12 carbon atoms.

2. A process of claim 1, said process comprising reacting about one mole of a starting compound having the general formula:

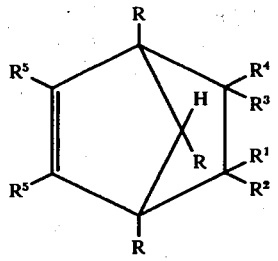

wherein:

a. each of R, $R^2$ and $R^4$ when taken singly is a hydrogen atom, an alkyl group containing from 1 to about 15 carbon atoms, an aryl group containing from 6 to about 15 carbon atoms or a cycloalkyl group containing from 4 to about 10 carbon atoms;

b. each $R^1$ and $R^3$ when taken singly is a hydrogen atom, an alkyl group containing from 1 to about 15 carbon atoms, an aryl group containing from 6 to about 15 carbon atoms, a cycloalkyl group containing from 4 to about 10 carbon atoms or an alkenyl group containing from 2 to about 10 carbon atoms or $R^1$ and $R^3$ taken together form the group —CHY.CY=CY— in which Y is a hydrogen atom or a methyl group or $R^1$ and $R^2$ taken together form an alkylidene group containing from 1 to about 6 carbon atoms; and c. $R^5$ is a hydrogen atom or an alkyl group containing from 1 to about 15 carbon atoms; with about 0.1 to 4 mole of sulphur at a temperature of up to 180° C to form an intermediate product containing trithiolan compound and reacting said intermediate with said thiol compound in the presence of a base.

3. A process of claim 2 wherein said starting compound is selected from the group consisting of norbornene, 5-vinylnorbornene, dicyclopentadiene and methyl cyclopentadiene dimer.

4. A process as claimed in claim 1 wherein the thiol compound is a hydrocarbyl thiol or dithiol.

5. A process as claimed in claim 4 wherein the thiol compound is an aliphatic mercaptan having the general formula $R^6$—SH wherein $R^6$ is a straight or branched chain alkyl group containing from 1 to 12 carbon atoms.

6. A process as claimed in claim 1 wherein the thiol compound is selected from the group consisting of t-butyl mercaptan, ethyl mercaptan, n-propyl mercaptan, benzyl mercaptan, t-dodecyl mercaptan, sec. butyl mercaptan, 2,5-dimercapto- 1,3,4-thiadiazole, 2-mercaptobenzoic acid, mercaptosuccinic acid, mercaptoacetic acid, thioacetic acid, thiobenzoic acid, n-hexamethiol, n-butanethiol, sodium t-butyl mercaptide, 1,6-hexane dithiol and p-thiocresol.

7. A process as claimed in claim 1 wherein the base is selected from the group consisting of a metal hydroxide, a quaternary ammonium salt, an aliphatic primary, secondary or tertiary mono, di or polyamine and a polyalkylene polyamine.

8. A process as claimed in claim 1 wherein the base is selected from the group consisting of aqueous sodium hydroxide, aqueous potassium hydroxide, aqueous ammonia, aqueous benzyl trimethyl ammonium hydroxide pyridine, sodium t-butyl mercaptide, n-butylamine, triethylamine, diisopropylamine, t-butylamine, hexamethylene diamine, tetraethylene pentamine and triethylene tetramine.

9. A process as claimed in claim 1 wherein the reaction is carried out at a temperature of from 50° to 140° C.

10. A process as claimed in claim 1 wherein the trithiolan compound and thiol are reacted in a molar ratio of from 0.5:1 to 4:1.

11. A process as claimed in claim 1 wherein the reaction is carried out in an inert solvent selected from the group consisting of benzene, xylene, toluene, petroleum ether and mineral oil.

12. A sulphur compound prepared by the process as claimed in claim 1.

13. A sulphur compound prepared by the process of claim 2.

14. A sulphur compound prepared by the process of claim 3.

15. A sulphur compound prepared by the process of claim 5.

16. A lubricating composition comprising a major amount of a lubricating oil and a minor amount of at least one sulphur compound as claimed in claim 12.

17. An oil concentrate comprising a minor amount of a lubricating oil and a major amount of at least one sulphur compound as claimed in claim 12.

* * * * *

UNITED STATES PATENT OFFICE

CERTIFICATE OF CORRECTION

Patent No. 4,012,331 Dated March 15, 1977

Inventor(s) Gerald John Joseph Jayne et al.

It is certified that error appears in the above-identified patent and that said Letters Patent are hereby corrected as shown below:

The top "$R^3$" in formula (A) in Column 2, lines 30-40, should read -- $R^4$ --

Signed and Sealed this

Tenth Day of May 1977

[SEAL]

*Attest:*

RUTH C. MASON
*Attesting Officer*

C. MARSHALL DANN
*Commissioner of Patents and Trademarks*